US010412501B2

(12) United States Patent
Uchida

(10) Patent No.: US 10,412,501 B2
(45) Date of Patent: Sep. 10, 2019

(54) CAPACITIVE TRANSDUCER SYSTEM, CAPACITIVE TRANSDUCER, AND ACOUSTIC SENSOR

(71) Applicant: OMRON Corporation, Kyoto (JP)

(72) Inventor: Yuki Uchida, Shiga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 15/808,736

(22) Filed: Nov. 9, 2017

(65) Prior Publication Data

US 2018/0167741 A1 Jun. 14, 2018

(30) Foreign Application Priority Data

Dec. 8, 2016 (JP) ..... 2016-238141

(51) Int. Cl.
*H04R 9/08* (2006.01)
*H04R 19/00* (2006.01)
*H04R 19/04* (2006.01)

(52) U.S. Cl.
CPC ..... *H04R 9/08* (2013.01); *H04R 19/005* (2013.01); *H04R 19/04* (2013.01); *H04R 2201/003* (2013.01); *H04R 2410/03* (2013.01)

(58) Field of Classification Search
CPC .... H04R 19/005; H04R 19/016; H04R 19/04; H04R 19/019; H04R 19/08; H04R 19/013;

(Continued)

(56) References Cited

U.S. PATENT DOCUMENTS 6,714,654 B2 3/2004 Lichtblau
7,888,754 B2 * 2/2011 Omura ..... B81B 3/0021 257/419

(Continued)

FOREIGN PATENT DOCUMENTS

EP 2560408 A2 2/2013
JP 2011-250170 A 12/2011

OTHER PUBLICATIONS

Martin et al., A Micromachined Dual-Backplate Capacitve Microphone for Aeroacoustic Measurements, Dec. 2007, Journal of Microelectromechanical Systems, vol. 16, No. 6, pp. 1289-1301 (Year: 2007).*

(Continued)

*Primary Examiner* — Fan S Tsang
*Assistant Examiner* — Angelica M McKinney
(74) *Attorney, Agent, or Firm* — Osha Liang LLP

(57) ABSTRACT

A capacitive transducer system has a capacitive transducer, and a controller. The capacitive transducer includes a first fixed electrode, a second fixed electrode, and a vibration electrode disposed between the first fixed electrode and the second fixed electrode so as to face the first and second fixed electrodes through gaps. A first capacitor is formed by the first fixed electrode and the vibration electrode. A second capacitor is formed by the second fixed electrode and the vibration electrode. The capacitive transducer is configured to convert transformation of the vibration electrode into changes in capacitance in the first capacitor and the second capacitor. The controller is configured to process voltages supplied to the first capacitor and the second capacitor and/or signals based on the changes in capacitance of the first capacitor and the second capacitor.

12 Claims, 10 Drawing Sheets

(58) Field of Classification Search
CPC ..... H04R 3/06; H04R 3/08; H04R 2201/003; H04R 2410/03; H04R 31/00; B81B 3/0021; H01L 29/84
See application file for complete search history.

(56) References Cited

U.S. PATENT DOCUMENTS

| | | | | |
|---|---|---|---|---|
| 9,723,423 | B2 * | 8/2017 | Uchida | H04R 31/00 |
| 2008/0144874 | A1 | 6/2008 | Wu et al. | |
| 2009/0200620 | A1 * | 8/2009 | Omura | B81B 3/0021 257/419 |
| 2010/0096714 | A1 * | 4/2010 | Nakatani | G01L 9/0042 257/419 |
| 2011/0108933 | A1 * | 5/2011 | Nakatani | B81C 1/00238 257/415 |
| 2013/0069179 | A1 | 3/2013 | Ishimoto et al. | |
| 2013/0236037 | A1 | 9/2013 | Weigold et al. | |
| 2015/0125003 | A1 | 5/2015 | Wiesbauer et al. | |
| 2015/0264476 | A1 | 9/2015 | Uchida | |
| 2015/0296307 | A1 * | 10/2015 | Shao | H04R 19/04 381/174 |
| 2016/0037266 | A1 * | 2/2016 | Uchida | H04R 7/06 381/71.8 |
| 2018/0063644 | A1 * | 3/2018 | Bach | H04R 3/06 |

OTHER PUBLICATIONS

Search Report issued in European Application No. 17196739.1, dated May 29, 2018 (16 pages).

* cited by examiner 3
5
7
8
9
10
13
IN
Volt1
Volt2
Volt
IN1
IN2
ASIC
MEMS
BP
Sub
VP

CAPACITIVE TRANSDUCER SYSTEM, CAPACITIVE TRANSDUCER, AND ACOUSTIC SENSOR

CROSS-REFERENCE TO RELATED APPLICATION

This application is based on Japanese Patent Application No. 2016-238141 filed with the Japan Patent Office on Dec. 8, 2016, the entire contents of which are incorporated herein by reference.

BACKGROUND

Field

The present invention relates to a capacitive transducer system, a capacitive transducer, and an acoustic sensor. More specifically, the present invention relates to a capacitive transducer system, a capacitive transducer, and an acoustic sensor, being configured in a capacitor structure formed by the MEMS technique and including a vibration electrode film and a back plate.

Related Art

There have hitherto been used a product using an acoustic sensor called an ECM (Electret Condenser Microphone) as a small-sized microphone. However, the ECM is easily affected by heat, and in terms of digitization support and size reduction, a microphone using a capacitive transducer is more excellent, the capacitive transducer being manufactured by using the MEMS (Micro Electro Mechanical Systems) technique (hereinafter, this microphone is also referred to as an MEMS microphone). Thus, in the recent years, the MEMS microphone is being employed (e.g., see Japanese Unexamined Patent Publication No. 2011-250170).

Some of the capacitive transducers as described above have achieved a figuration by using the MEMS technique, the figuration being where a vibration electrode film that vibrates under pressure is disposed facing a back plate fixed with the electrode film through a gap. The figuration of the capacitive transducer as above can be achieved, for example, by the following steps: forming on a semiconductor substrate a vibration electrode film and such a sacrifice layer as to cover the vibration electrode film; forming a back plate on the sacrifice layer; and removing the sacrifice layer. With the semiconductor manufacturing technique applied to the MEMS technique as above, it is possible to obtain an extremely small capacitive transducer.

In such a capacitive transducer, a noise is considered to result from some causes, such as a noise based on Brownian motion of air accumulated between the semiconductor substrate and the vibration electrode film, and this noise may hinder improvement in an SN ratio. In contrast, there is known a technique of preparing two microphones and subtracting output signals from both of them to cancel a noise component (e.g., U.S. Pat. No. 6,714,654 or US Patent No. 2008/144874 A).

In the above technique, when a source of a noise is outside the microphone, the noise can be canceled. However, when a cause of a noise is inside the microphone, the noise occurs independently in each of the microphones, which makes it difficult to effectively cancel the noise.

There is also known a configuration of a capacitive transducer in which a plurality of vibration electrode plates are disposed in parallel on one semiconductor substrate (e.g., US Patent No. 2008/144874 A). In such a case, the SN ratio can be improved by using the following characteristics: a total value of signals is a sum of signals of the respective transducers, whereas a total noise value is a root-sum-square value of noise values from the respective transducers. However, this technique is disadvantageous in that the size becomes large as the capacitive transducer.

SUMMARY

One or more embodiments of the present invention improves an SN ratio of a capacitive transducer system, a capacitive transducer, or an acoustic sensor, with a more reliable or simpler configuration.

A capacitive transducer system according to one or more embodiments of the present invention includes a capacitive transducer, which includes two fixed electrodes being a first fixed electrode and a second fixed electrode, and a vibration electrode disposed between the first fixed electrode and the second fixed electrode so as to face both fixed electrodes through gaps, and in which a first capacitor is made up of the first fixed electrode and the vibration electrode, and a second capacitor is made up of the a second fixed electrode and the vibration electrode, the capacitive transducer being configured to convert transformation of the vibration electrode into changes in capacitance in the first capacitor and the second capacitor; and a controller configured to process voltages supplied to the first capacitor and the second capacitor and/or signals based on the changes in capacitance of the first capacitor and the second capacitor. In the capacitive transducer system, the respective signals based on the changes in capacitance of the first capacitor and the second capacitor are added or subtracted in such a direction as to cancel each other.

In general, there may be employed a technique of canceling noises by subtracting the respective signals based on changes in capacitance of two capacitors. In this case, however, it is considered that a total noise is specified by a root-sum-square value of noises of the respective capacitors, and effectively canceling the noises is difficult. In contrast, in one or more embodiments of the present invention, two capacitors, the first capacitor and the second capacitor, are configured using the common vibration electrode. Hence signals based on changes in capacitance in the first capacitor and the second capacitor are added or subtracted in such a direction as to cancel each other, thus enabling more reliable cancellation of noises. It is thereby possible to improve the SN ratio as a capacitive transducer system.

Here, "signals based on changes in capacitance in the first capacitor and the second capacitor are added or subtracted in such a direction as to cancel each other" means, for example, that one signal is subtracted from the other signal when the signals based on the changes in capacitance in the first capacitor and the second capacitor have the same polarity. Further, it means that both signals are added to each other when the signals based on the changes in capacitance in the first capacitor and the second capacitor have reversed polarities.

Further, in one or more embodiments of the present invention, a value of at least one of an electrode area, an electrode position, an inter-electrode gap, a supplied voltage, and a gain of each of the first fixed electrode, the second fixed electrode, and the vibration electrode may be decided such that a level of the signal based on the change in capacitance of the first capacitor and a level of the signal based on the change in capacitance of the second capacitor are different from each other, and a noise level of the first capacitor and a noise level of the second capacitor are equivalent to each other.

Here, the signal based on the change in capacitance in the capacitor made up of the fixed electrode and the vibration electrode is influenced by an electrode area, an electrode position, an inter-electrode gap, a supplied voltage, a gain, or the like. Using this, in one or more embodiments of the present invention, a value of at least one of the electrode area, the electrode position, the inter-electrode gap, the supplied voltage, and the gain of each of the first fixed electrode, the second fixed electrode, and the vibration electrode is decided such that a level of the signal based on the change in capacitance of the first capacitor and a level of the signal based on the change in capacitance of the second capacitor are different from each other, and a noise level of the first capacitor and a noise level of the second capacitor are equivalent to each other.

Accordingly, when the respective signals based on the changes in capacitance of the first capacitor and the second capacitor are added or subtracted in such a direction as to cancel each other, the noises are canceled and the signals are preferentially left while the signal levels decrease. This can lead to improvement in the SN ratio of a signal obtained as the capacitive transducer system.

Further, in one or more embodiments of the present invention, the first fixed electrode may be a semiconductor substrate having an opening, the second fixed electrode may be a fixed electrode film disposed so as to face the opening of the semiconductor substrate, and formed in a back plate having sound holes that allow passage of air, and the vibration electrode may be the vibration electrode film disposed between the back plate and the semiconductor substrate so as to face the back plate and the semiconductor substrate respectively through gaps.

It is thereby possible to automatically reverse the polarities of the respective signals based on the changes in capacitance of the first capacitor and the second capacitor. Hence the noises can be canceled just by adding the respective signals based on the changes in capacitance of the first capacitor and the second capacitor. This can lead to improvement in the SN ratio of a signal obtained from the capacitive transducer system.

Further, in one or more embodiments of the present invention, the semiconductor substrate may have the surface to be conductive by ion planting or the like, or may be formed of a conductive material. Accordingly, in the MEMS manufacturing process, the first fixed electrode can be formed more easily without an additional film formation process. Further, in one or more embodiments the present invention, the fixed electrode film may be formed on the surface of a portion in the semiconductor substrate, the portion facing the vibration electrode film. Thereby, the shape and area of the first fixed electrode can be adjusted with higher flexibility.

Further, in one or more embodiments of the present invention, the vibration electrode film may be provided with a stopper that comes into contact with the semiconductor substrate when the vibration electrode film is transformed to the semiconductor substrate side, and an insulation made of an insulator may be provided at a tip of the stopper on the semiconductor substrate side. Thereby, even when the stopper on the vibration electrode film and the semiconductor substrate come into contact with each other, it is possible to avoid occurrence of an electrical short circuit therebetween.

Further, in one or more embodiments of the present invention, by electrical connection between a signal line of the signal based on the change in capacitance of the first capacitor and a signal line of the signal based on the change in capacitance of the second capacitor, the respective signals based on the changes in capacitance of the first capacitor and the second capacitor are added or subtracted in such a direction as to cancel each other. Accordingly, it is possible to improve the SN ratio of an output signal itself from the capacitive transducer before the output signal is inputted into the controller, and thereby to reduce a burden of the controller.

Further, in one or more embodiments of the present invention, the signal based on the change in capacitance of the first capacitor and the signal based on the change in capacitance of the second capacitor are calculated by addition or subtraction in such a direction as to cancel each other in the controller. Accordingly, the noises in the signal based on the change in capacitance of the first capacitor and the signal based on the change in capacitance of the second capacitor can be canceled in the controller with higher flexibility, to more reliably improve the SN ratio of output from the capacitive transducer system.

Further, in one or more embodiments of the present invention, the capacitive transducer includes a semiconductor substrate having an opening; a back plate disposed so as to face the opening of the semiconductor substrate, and having sound holes that allow passage of air; and a vibration electrode film disposed so as to face the back plate through a gap. The first fixed electrode and the second fixed electrode may be formed by dividing the fixed electrode film formed on the back plate, the vibration electrode may be a vibration electrode film, and the signal based on the change in capacitance of the first capacitor and the signal based on the change in capacitance of the second capacitor may be calculated by addition or subtraction in such a direction as to cancel each other in the controller.

That is, in this case, the fixed electrode film formed in the back plate is divided to form the first fixed electrode and the second fixed electrode. Then, the first capacitor is formed of the first fixed electrode and a portion of the vibration electrode film, the portion facing the first fixed electrode, and the second capacitor is formed of the second fixed electrode and a portion of the vibration electrode film, the portion facing the second fixed electrode. With this configuration, since the polarities of the signals based on the changes in capacitance of the first capacitor and the second capacitor become the same, the noises can be canceled by subtracting these signals from each other, to improve the SN ratio of the signal of the capacitive transducer system. Further, in this case, the fixed electrode film provided in the back plate is divided to form the first fixed electrode and the second fixed electrode, thus making it possible to decide the areas, the shapes and the like of these fixed electrodes with higher flexibility.

One or more embodiments of the present invention may be an acoustic sensor, including the above capacitive transducer system, and configured to detect sound pressure. It is thereby possible to provide an acoustic sensor having a higher SN ratio.

One or more embodiments of the present invention may be a capacitive transducer including: a semiconductor substrate having an opening; a back plate disposed so as to face the opening of the semiconductor substrate, and having sound holes that allow passage of air; and a vibration electrode film disposed between the back plate and the semiconductor substrate so as to face the back plate and the semiconductor substrate respectively through gaps, the capacitive transducer being configured to convert transformation of the vibration electrode film into changes in capacitance between the vibration electrode film and the back plate and between the vibration electrode film and the semiconductor substrate. In the capacitive transducer, a first capacitor may be made up of a first fixed electrode provided in the semiconductor substrate and the vibration electrode film, and transformation of the vibration electrode film may be converted into a change in capacitance of the first capacitor, and a second capacitor may be made up of a second fixed electrode provided in the back plate and the vibration electrode film, and transformation of the vibration electrode film may be converted into a change in capacitance of the second capacitor.

In that case, by electrical connection between a signal line of the signal based on the change in capacitance of the first capacitor and a signal line of the signal based on the change in capacitance of the second capacitor, the respective signals based on the changes in capacitance of the first capacitor and the second capacitor may be added to each other and outputted. In this case, the signal based on the change in capacitance of the first capacitor and the signal based on the change in capacitance of the second capacitor have reversal polarity. Thus, by being added to each other and outputted, these signals are automatically added to each other in such a direction as to cancel each other.

Also in this case, a value of at least one of an electrode area, an electrode position, and an inter-electrode gap of each of the first fixed electrode, the second fixed electrode, and the vibration electrode may be decided such that a level of the signal based on the change in capacitance of the first capacitor and a level of the signal based on the change in capacitance of the second capacitor are different from each other, and a noise level of the first capacitor and a noise level of the second capacitor are equivalent to each other.

Also in this case, the semiconductor substrate may have the surface to be conductive, or may be formed of a conductive material. The fixed electrode film may be formed on the surface of a portion in the semiconductor substrate, the portion facing the vibration electrode film.

Also in this case, the vibration electrode film may be provided with a stopper that comes into contact with the semiconductor substrate when the vibration electrode film is transformed to the semiconductor substrate side, and an insulation made of an insulator may be provided at a tip of the stopper on the semiconductor substrate side.

Also in this case, one or more embodiments of the present invention may be an acoustic sensor including the above capacitive transducer and configured to detect sound pressure.

The structures described above can be used in appropriate combination.

According to one or more embodiments of the present invention, it is possible to improve the SN ratio of a capacitive transducer system, a capacitive transducer, or an acoustic sensor, with a more reliable or simpler configuration.

DETAILED DESCRIPTION

Hereinafter, embodiments of the present invention will be described with reference to the drawings. Each of the embodiments shown below is an aspect of the present invention, and is not intended to restrict the technical scope of the present invention. In the following, the case of using a capacitive transducer as an acoustic sensor will be described. However, the capacitive transducer according to the present invention is configured to detect displacement of a vibration electrode film, and can thus be used as a sensor other than the acoustic sensor. For example, it may be used as a pressure sensor, or may be used as an acceleration sensor, an inertia sensor, or some other sensor. It may also be used as an element other than the sensor, such as a speaker for converting an electrical signal into displacement. Further, the placement of a back plate, a vibration electrode film, a back chamber, a semiconductor substrate, and the like in the following description is an example. This placement is not restrictive so long as an equivalent function is exerted. For example, the placement of the back plate and the vibration electrode film may be reversed. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
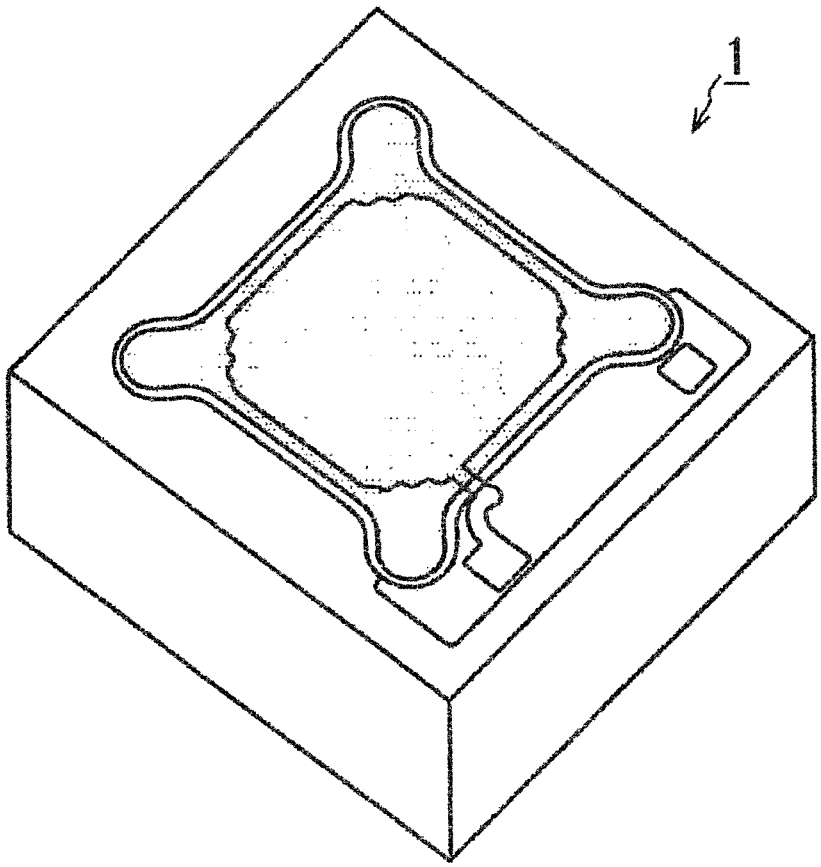
FIG. 1 is a perspective view illustrating an example of a conventional acoustic sensor manufactured by the MEMS technique.
Figure 2:
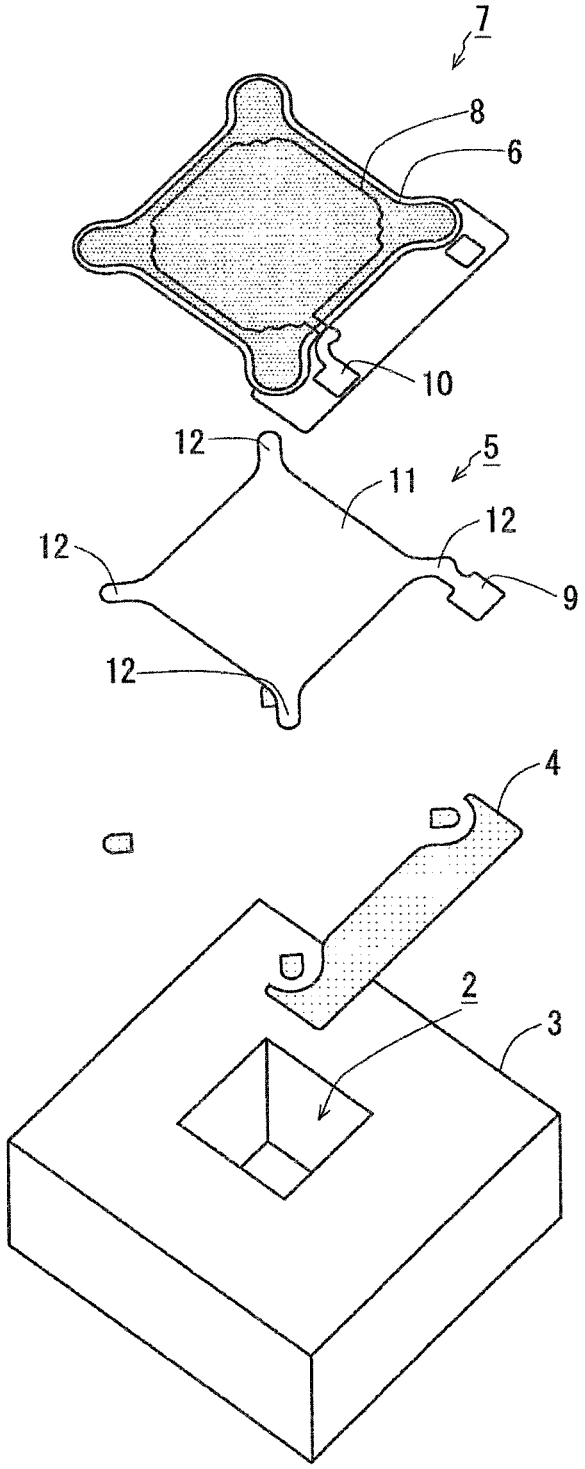
FIG. 2 is an exploded perspective view illustrating an example of an internal structure of the conventional acoustic sensor.

FIG. 1 is a perspective view illustrating an example of a conventional acoustic sensor 1 manufactured by the MEMS technique. FIG. 2 is an exploded perspective view illustrating an example of an internal structure of the acoustic sensor 1. The acoustic sensor 1 is a laminated body formed by laminating an insulating film 4, a vibration electrode film (diaphragm) 5, and a back plate 7 on the top surface of a semiconductor substrate 3 (hereinafter also referred to simply as a substrate) provided with a back chamber 2. The back plate 7 has a structure where a fixed electrode film 8 is formed on a fixed plate 6, and is formed by disposing the fixed electrode film 8 on the fixed plate 6 on the substrate 3 side. Sound holes are provided all over the fixed plate 6 of the back plate 7 as a large number of punched holes (each of meshed points on the fixed plate 6 illustrated in FIG. 2 corresponds to each of the sound holes). Further, a fixed electrode pad 10 for acquiring an output signal is provided at one of four corners of the fixed electrode film 8.

The substrate 3 can be formed by a single crystal silicon, for example. The vibration electrode film 5 can be formed by conductive polycrystal silicon, for example. The vibration electrode film 5 is a substantially rectangular thin film, in which fixed parts 12 are provided at four corners of a vibration part 11 having a substantially quadrilateral shape that vibrates.

The vibration electrode film 5 is disposed on the top surface of the substrate 3 so as to cover the back chamber 2, and is fixed to the substrate 3 at the four fixed parts 12 as anchor parts. The vibration part 11 of the vibration electrode film 5 reacts sensitively to sound pressure and vibrates vertically.

The vibration electrode film 5 is not in contact with the substrate 3 or the back plate 7 in a place other than the four fixed parts 12. This allows smoother vertical vibration of the vibration electrode film 5 after sensitive reaction to sound pressure. A vibrating membrane electrode pad 9 is provided in one of the fixed parts 12 at the four corners of the vibration part 11. The fixed electrode film 8 provided in the back plate 7 is provided so as to correspond to the vibrating portion of the vibration electrode film 5 except for the fixed parts 12 at the four corners. This is because the fixed parts 12 at the four corners of the vibration electrode film 5 do not react sensitively to sound pressure to vibrate and hence capacitance between the vibration electrode film 5 and the fixed electrode film 8 remains unchanged.

When sound reaches the acoustic sensor 1, the sound passes through the sound hole to apply sound pressure to the vibration electrode film 5. That is, sound pressure is applied to the vibration electrode film 5 through this sound hole. Further, providing the sound hole facilitates air in an air gap between the back plate 7 and the vibration electrode film 5 to easily escape to the outside, which decreases thermal noise, leading to noise reduction.

In the acoustic sensor 1, with the structure described above, the vibration electrode film 5 vibrates upon receipt of sound, and the distance between the vibration electrode film 5 and the fixed electrode film 8 changes. When the distance between the vibration electrode film 5 and the fixed electrode film 8 changes, capacitance between the vibration electrode film 5 and the fixed electrode film 8 changes. Hence it is possible to detect sound pressure as an electrical signal by previously applying a direct-current voltage between the vibrating membrane electrode pad 9 electrically connected with the vibration electrode film 5 and the fixed electrode pad 10 electrically connected with the fixed electrode film 8, and taking out the above-mentioned change in capacitance as an electrical signal. The output signal from the acoustic sensor 1 is inputted into an ASIC (not illustrated) as the controller and processed appropriately. The voltage applied to each of the vibration electrode film 5 and the fixed electrode film 8 is also supplied via the ASIC. Hereinafter, a system including the acoustic sensor 1 and the ASIC is referred to as an acoustic sensor system. This acoustic sensor system corresponds to the capacitive transducer system in one or more embodiments of the present invention.

In such an acoustic sensor as above, a noise is considered to result from some causes, such as a noise based on Brownian motion of air accumulated between the semiconductor substrate and the vibration electrode film, and this noise may hinder improvement in the SN ratio. In contrast, in one or more embodiments, a change in capacitance between the vibration electrode film 5 and the substrate 3 is taken out as an electrical signal, along with a change in capacitance between the vibration electrode film 5 and the fixed electrode film 8 of the back plate 7, and those signals are added or subtracted to cancel noises and improve the SN ratio of the obtained signal.

Figure 3B:
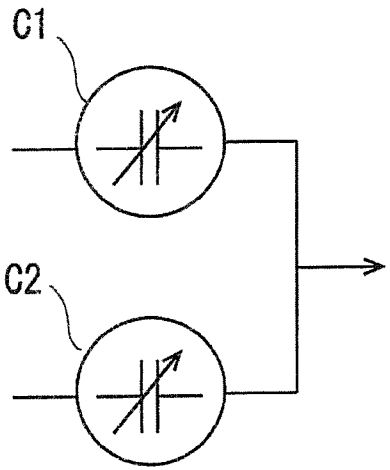
FIGS. 3A and 3B are a sectional view and an equivalent circuit diagram of the vicinity of a back plate and a vibration electrode film of an acoustic sensor according to one or more embodiments of the present invention.
Figure 3A:
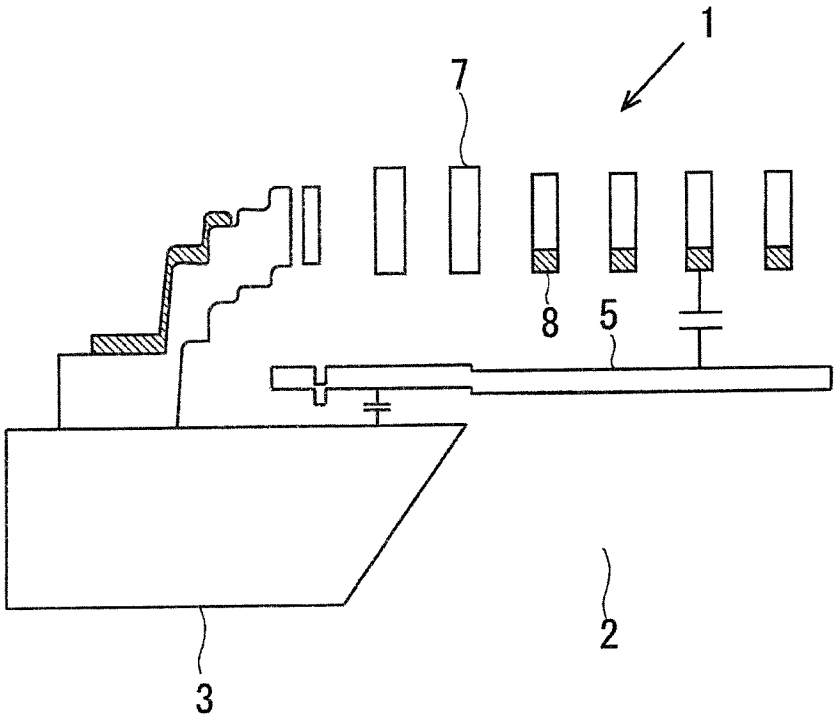

FIG. 3A is a sectional view of the vicinity of the back plate 7 and the vibration electrode film 5 of the acoustic sensor 1 in one or more embodiments, and FIG. 3B is an equivalent circuit diagram obtained in that configuration. In one or more embodiments, as illustrated in FIG. 3A, when the vibration electrode film 5 is transformed by pressure, a change in capacitance between the vibration electrode film 5 and the fixed electrode film 8 of the back plate 7 is detected as an electrical signal, while a change in capacitance between the vibration electrode film 5 and the substrate 3 is also detected as an electrical signal. Both detected signals are added to each other to obtain a signal, which is taken as an output signal of the capacitive transducer. That is, in one or more embodiments, as illustrated in FIG. 3B, the vibration electrode film 5 and the fixed electrode film 8 of the back plate 7 are made to constitute a first capacitor C1, and the vibration electrode film 5 and the substrate 3 are made to constitute a second capacitor C2. Then, signals based on changes in capacitance of the first capacitor C1 and the second capacitor C2 are added to each other.

In that case, the signal based on the change in capacitance of the first capacitor C1 (hereinafter also referred to as the signal from the first capacitor C1) and the signal based on the change in capacitance of the second capacitor C2 (hereinafter also referred to as the signal from the second capacitor C2) have reversed polarities. A noise of the signal from the first capacitor C1 and a noise of the signal from the second capacitor C2 also have reversed polarities. Further, a ratio of levels of the signal from the first capacitor C1 and the signal from the second capacitor C2 is basically different from a ratio of noise levels concerning those signals. This is because, a generation process for the above noise is not necessarily the same as a generation process for the signal from the first capacitor C1 and the signal from the second capacitor C2.

Figure 4B:
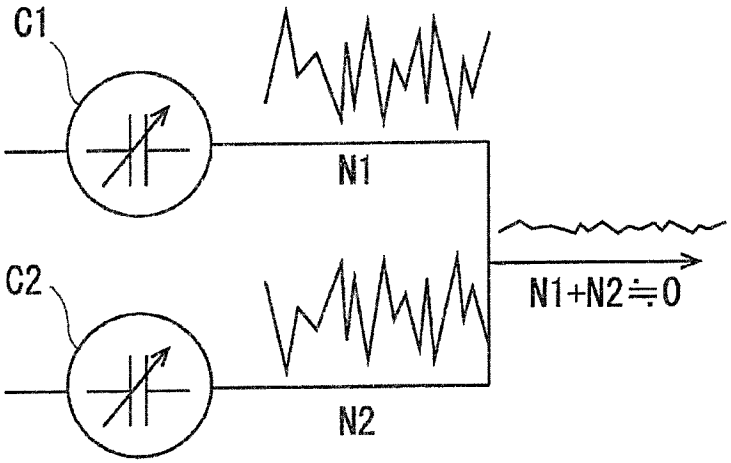
FIGS. 4A and 4B are views for describing states of signals and noises from a first capacitor and a second capacitor according to one or more embodiments of the present invention.
Figure 4A:
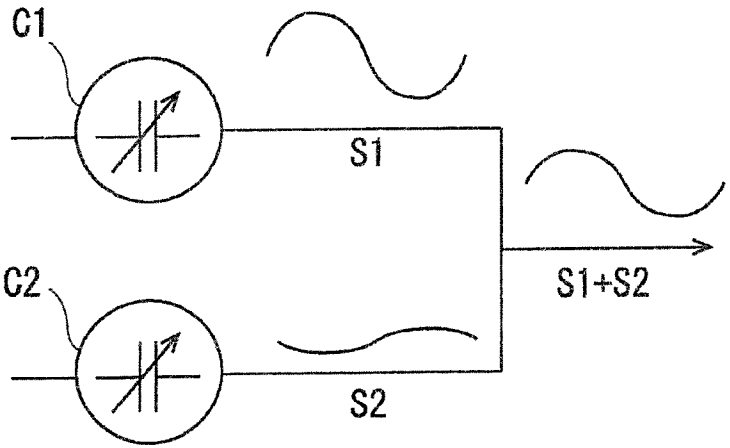

In one or more embodiments, the level of the noise concerning the signal from the first capacitor C1 is matched with the level of the noise concerning the signal from the second capacitor C2. Accordingly, as illustrated in FIG. 4A, even after addition of a signal S1 from the first capacitor C1 and a signal S2 from the second capacitor C2, a signal S1+S2 is left (S1>S1+S2, since S1 and S2 have reversed polarities). Meanwhile, as illustrated in FIG. 4B, after addition of a noise N1 concerning the signal from the first capacitor C1 and a noise N2 concerning the signal from the second capacitor C2, the obtained noise is substantially zero. Hence the SN ratio of the signal obtained as the acoustic sensor system can be improved as much as possible.

Suppose two separate acoustic sensors are prepared and noises concerning signals from capacitors constituting those acoustic sensors are added to each other, with the noises being independent of each other, a root-sum-square value of the respective noises becomes a total noise even when the signals have reversed polarities, and hence significant improvement in the SN ratio cannot be expected. In contrast, in the configuration of one or more embodiments, since the first capacitor C1 and the second capacitor C2 which include the common vibration electrode film 5 are used, the noises concerning the signals from these capacitors have a high correlation. Hence, adding the noises concerning the signals from both capacitors enables more reliable cancellation of the noises and more efficient improvement in the SN ratio.

The above respect can be mathematically represented as one idea as follows.

It is assumed here that the signal based on the change in capacitance of the first capacitor C1 is S1, the signal based on the change in capacitance of the second capacitor C2 is S2, the noise of the signal based on the change in capacitance of the first capacitor C1 is N1, and the noise of the signal based on the change in capacitance of the second capacitor C2 is N2. Then, SNR1 as an SN ratio of the signal based on the change in capacitance of the first capacitor C1, and SNR2 as an SN ratio of the signal based on the change in capacitance of the second capacitor C2 can be expressed as Expression (1):

$$SNR1=S1/N1, SNR2=S2/N2 \quad (1)$$

Further, since the ratio of S1 and S2 and the ratio of N1 and N2 are different as described above, Expression (2) holds:

$$S2=\alpha S1, N2=\beta N1 \quad (2)$$

Then, SNRtotal, which is an SN ratio of the whole acoustic sensor system can be expressed as Expression (3).

$$\begin{aligned} SNRtotal &= (S1-S2)/(N1-N2) \quad (3) \\ &= (S1-\alpha S1)/(N1-\beta N1) \\ &= (1-\alpha)/(1-\beta)\times SNR1 \end{aligned}$$

In Expression (3) above, when $\alpha<1$ and $\beta\approx1$, Expression (4) holds:

$$\begin{aligned} SNR\text{total} &= (1-\alpha)/(1-\beta)\times SNR1 \\ &>> SNR1 \\ &> \alpha/\beta\times SNR1 = SNR2 \quad (4) \end{aligned}$$

Namely, it is possible to make the SN ratio of the whole acoustic sensor system significantly higher than SNR1, which is the SN ratio of the signal based on the change only in the first capacitor C1, and SNR2, which is the SN ratio of the signal based on the change only in the second capacitor C2.

Next, a description will be given of a technique for matching the level of the noise concerning the signal from the first capacitor C1 with the level of the noise concerning the signal from the second capacitor C2. Here, the sensitivity of the change in the signal from the first capacitor C1 or the second capacitor C2 due to transformation of the vibration electrode film 5 can be expressed as Expression (5) below:

$$\text{Sensitivity} \propto c\times s\times V/g \quad (5)$$

where c is a constant representing a hardness of the vibration electrode film 5, s is an area of the vibration electrode film 5 constituting each capacitor, V is an inter-electrode voltage, and g is an inter-electrode gap. It is considered that Expression (5) substantially holds also for the noise concerning the signal from the first capacitor C1 or the second capacitor C2.

Figure 5B:
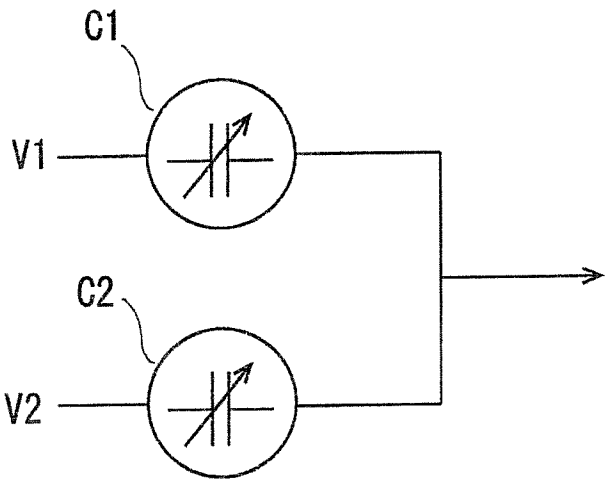
FIGS. 5A and 5B are views for describing a technique of matching noise levels of signals from the first capacitor and the second capacitor in an acoustic sensor according to one or more embodiments of the present invention.
Figure 5A:
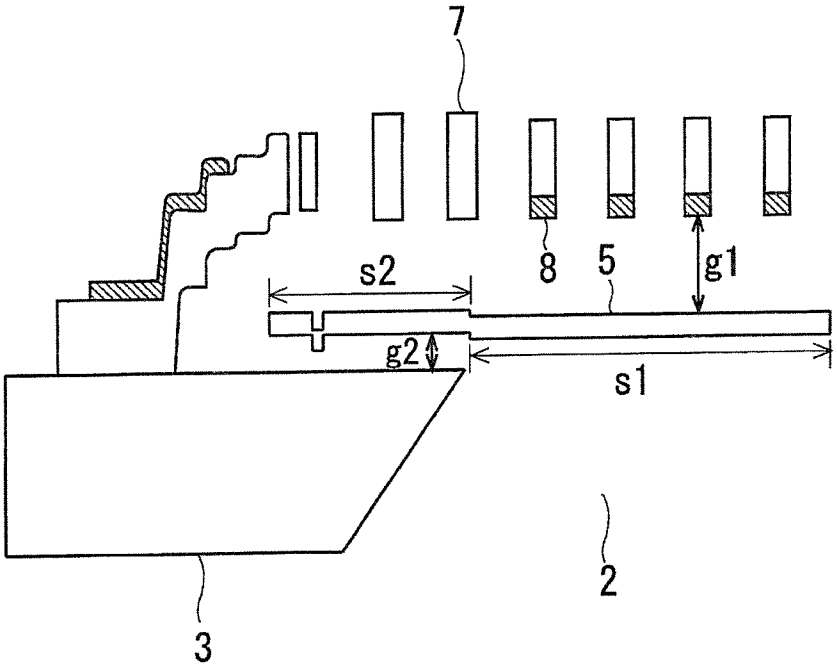

That is, in one or more embodiments, hardnesses c1 and c2, areas s1 and s2, inter-electrode voltages V1 and V2, and inter-electrode gaps g1 and g2 of the vibration electrode film 5, which forms the first capacitor C1 and the second capacitor C2 illustrated in FIG. 5B, are decided appropriately in terms of design. This allows matching between the noise concerning the signal from the first capacitor C1 and the noise concerning the signal from the second capacitor C2. Therefore, adding the noise concerning the signal from the first capacitor C1 and the noise concerning the signal from the second capacitor C2 enables both noises to be canceled and a total noise to be minimized. Note that the hardnesses c1 and c2 of the vibration electrode film 5, which forms the first capacitor C1 and the second capacitor C2, can be decided as mutually different values by changing regions to be used for the first capacitor C1 and the second capacitor C2 in the vibration electrode film 5, while the material of the vibration electrode film 5 is the same.

Here, the signal from the first capacitor C1 and the signal from the second capacitor C2 are added to each other by wiring among the vibrating membrane electrode pad 9 on the vibration electrode film 5, which is the common electrode for both capacitors, the fixed electrode pad 10 on the fixed electrode film 8 of the back plate 7, and an electrode pad 13 on the substrate 3, or wiring in the ASIC adjacent to the acoustic sensor 1, or by calculation.

Figures 6A, 6B, 6C, 6D:
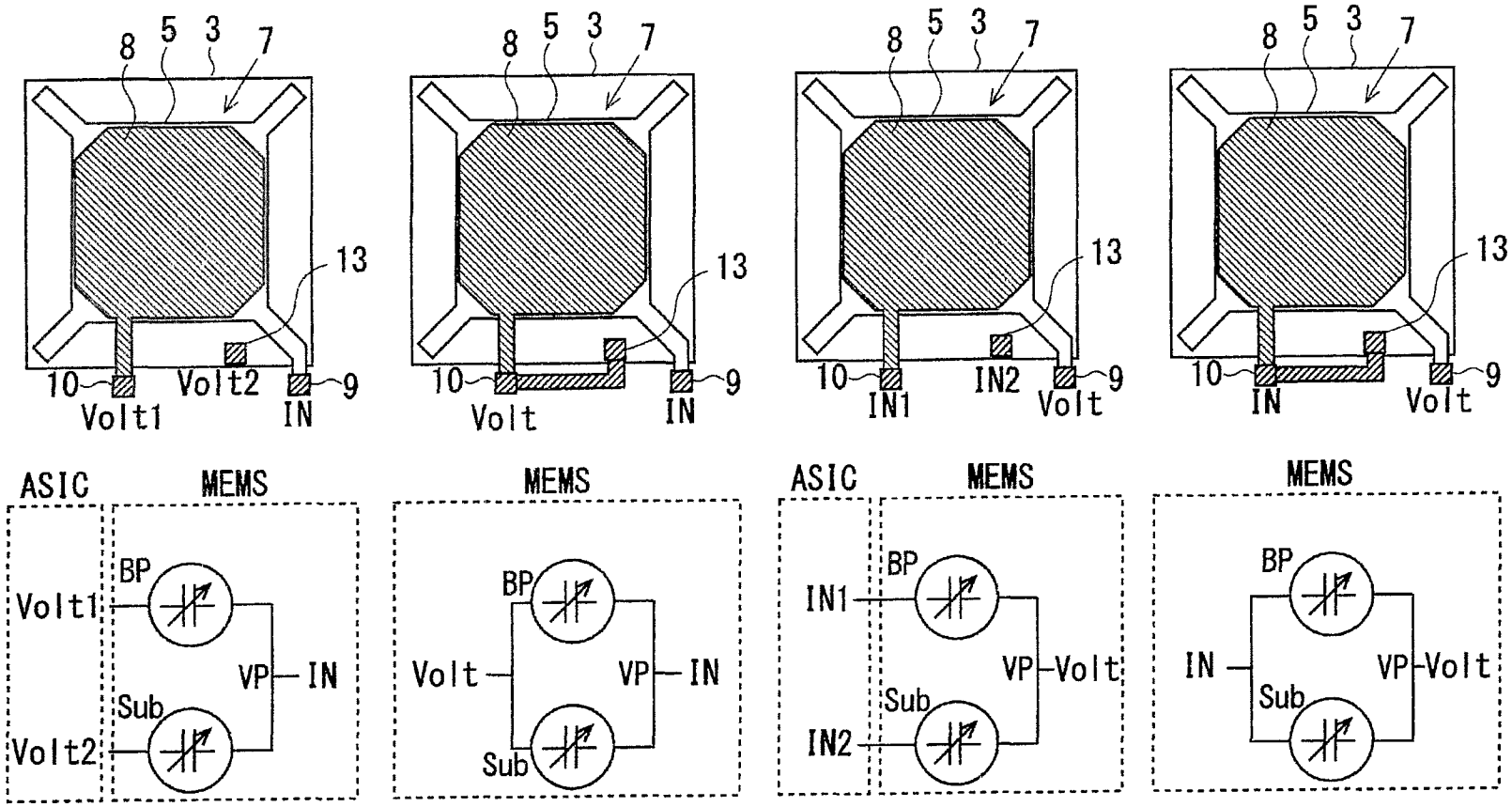
FIGS. 6A to 6D are views illustrating variations of wiring of the acoustic sensor according to one or more embodiments of the present invention.

FIGS. 6A to 6D illustrate variations of wiring in that case. Note that in the following description, a structure made up of the vibration electrode film 5, the fixed electrode film 8 in the back plate 7, and the substrate 3 may be referred to as a MEMS with respect to the ASIC. Further, in FIGS. 6A to 6D, VP means the vibration electrode film 5, BP means the fixed electrode film 8 of the back plate 7, and Sub means the substrate 3. FIG. 6A is an example where the vibrating membrane electrode pad 9 on the common vibration electrode film 5 in the MEMS is set to an output IN, and a voltage Volt1 is supplied from the ASIC to the fixed electrode pad 10 on the fixed electrode film 8, while a voltage Volt2 is supplied from the ASIC to the electrode pad 13 on the substrate 3.

In this case, values of the voltages Volt1, Volt2 supplied from the ASIC can be adjusted as appropriate. Further, the hardness c1 or c2 of the vibration electrode film 5, the area s1 or s2 of the vibration electrode film 5, and the inter-electrode gap g1 or g2 in the MEMS can be decided as appropriate. Hence in this wiring, all the parameters represented in Expression (5) can be adjusted. It is thereby possible to more reliably improve the SN ratio as the acoustic sensor system with higher flexibility by matching the levels of the noises N1 and N2 concerning the signal S1 from the first capacitor C1 and the signal S2 from the second capacitor C2, while providing a certain difference between the levels of the respective signals.

FIG. 6B is an example where the vibrating membrane electrode pad 9 on the common vibration electrode film 5 in the MEMS is set to the output IN, and the common voltage Volt (Volt1=Volt2) is supplied from the ASIC to the fixed electrode pad 10 on the fixed electrode film 8 of the back plate 7 and to the electrode pad 13 on the substrate 3. In this case, the parameters on the MEMS side (the hardness c1 or c2 of the vibration electrode film 5, the area s1 or s2 of the vibration electrode film 5, and the inter-electrode gap g1 or g2 in the MEMS) can be adjusted. Thus, adjusting only the parameters on the MEMS side makes it possible to match the levels of the noises N1 and N2 concerning the signal S1 from the first capacitor C1 and the signal S2 from the second capacitor C2, while providing a certain difference between the levels of the respective signals, so as to improve the SN ratio as the acoustic sensor system.

FIG. 6C is an example where the voltage Volt is supplied to the vibrating membrane electrode pad 9 on the common vibration electrode film 5 in the MEMS, the fixed electrode pad 10 on the fixed electrode film 8 of the back plate 7 is set to a first output IN1, the electrode pad 13 on the substrate 3 is set to a second output IN2, and those INs are inputted into the ASIC. In this case, while the parameters on the MEMS side (the hardness c1 or c2 of the vibration electrode film 5, the area s1 or s2 of the vibration electrode film 5, and the inter-electrode gap g1 or g2 in the MEMS) are adjusted, high-level adjustment can be performed in the ASIC, such as application of appropriate gains and offsets to the first output IN1 and the second output IN2 in the ASIC. It is thereby possible to more reliably improve the SN ratio as the acoustic sensor system by matching the levels of the noises N1 and N2 concerning the signal S1 from the first capacitor C1 and the signal S2 from the second capacitor C2, while providing a certain difference between the levels of the respective signals.

FIG. 6D is an example where the common voltage Volt is supplied to the vibrating membrane electrode pad 9 on the common vibration electrode film 5, the output of the fixed electrode pad 10 on the fixed electrode film 8 of the back plate 7 and the output of the electrode pad 13 on the substrate 3 are connected, and then the output IN is inputted into the ASIC. In this case, since adjustment of each output and each voltage in the ASIC is difficult, the parameters on the MEMS side (the hardness c1 or c2 of the vibration electrode film 5, the area s1 or s2 of the vibration electrode film 5, and the inter-electrode gap g1 or g2 in the MEMS) are adjusted. Thus, adjusting only the parameters on the MEMS side makes it possible to match the levels of the noises N1 and N2 concerning the signal S1 from the first capacitor C1 and the signal S2 from the second capacitor C2, while providing a certain difference between the levels of the respective signals, so as to improve the SN ratio as the acoustic sensor system.

Figure 7B:
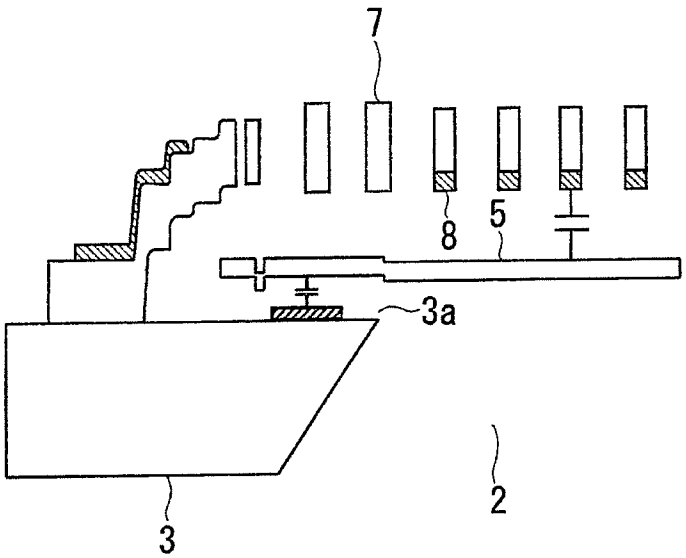
FIGS. 7A and 7B are views illustrating configuration examples of a fixed electrode film in a substrate according to one or more embodiments of the present invention.
Figure 7A:
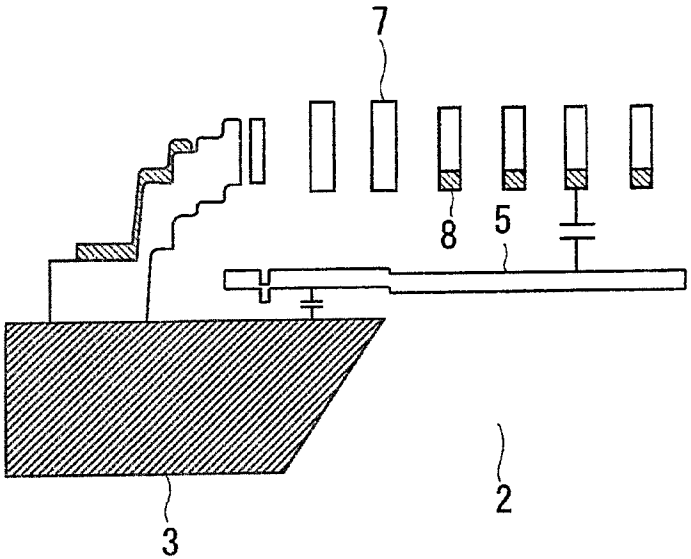

Although the second capacitor C2 are formed of the vibration electrode film 5 and the substrate 3 in one or more embodiments, in this case, the whole or the surface of the substrate 3 may be made conductive as illustrated in FIG. 7A. This enables the substrate 3 to be used as it is as the fixed electrode, without providing an additional film formation process. Meanwhile, as illustrated in FIG. 7B, a conductive fixed electrode may be separately provided on the surface of the substrate 3 on the vibration electrode film 5 side. This facilitates adjustment of the area of the fixed electrode of the second capacitor C2, thus enabling adjustment of the level and the noise level of the signal from the second capacitor C2 in a simpler or more accurate manner.

Figure 8B:
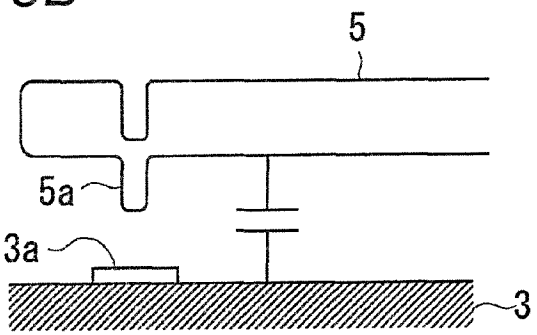
FIGS. 8A to 8C are views illustrating configuration examples of an insulation of a stopper on a vibration electrode film according to one or more embodiments of the present invention.
Figure 8C:
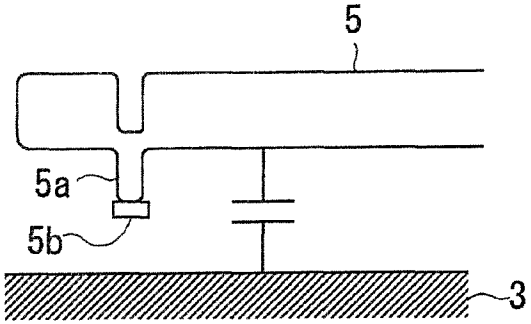
Figure 8A:
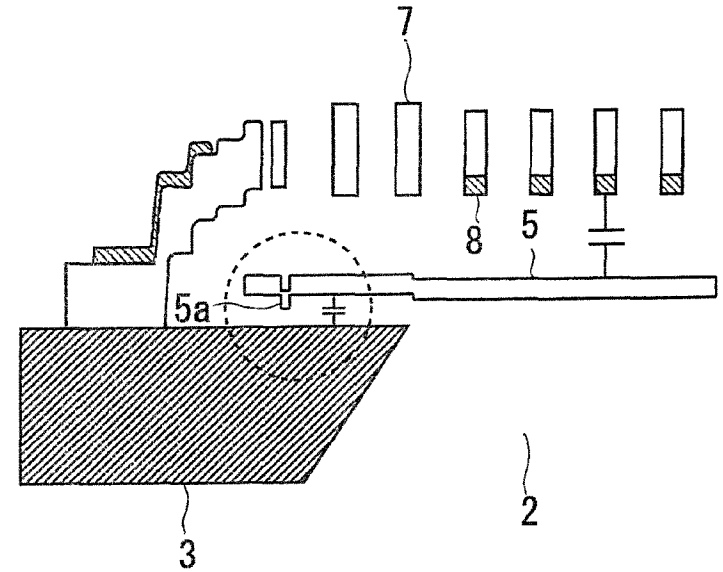

Note that in the second capacitor C2, as illustrated by a circle with a broken line in FIG. 8A, a stopper 5*a* for preventing sticking with the substrate 3 may be formed on the vibration electrode film 5. In such a case, when the vibration electrode film 5 and the substrate 3 come into contact with each other at the stopper 5*a*, the vibration electrode film 5 and the substrate 3 are liable to be electrically short-circuited via the stopper 5*a*. In contrast, in one or more embodiments, an insulation 3*a* made of an insulator may be formed on the substrate 3 as illustrated in FIG. 8B, or an insulation 5*b* made of an insulator may be provided at the tip of the stopper 5*a* on the vibration electrode film 5 as illustrated in FIG. 8C. It is thereby possible to prevent occurrence of an electrical short circuit when the vibration electrode film 5 and the substrate 3 come into contact with each other at the stopper 5*a*.

Next, using FIGS. 9A and 9B and FIGS. 10A and 10B, a description will be given of an example where the vibration electrode film 5 is taken as a common electrode, and the fixed electrode film 8 of the back plate 7 is divided into separate electrodes to configure the first capacitor C1 and the second capacitor C2.

Figure 9B:
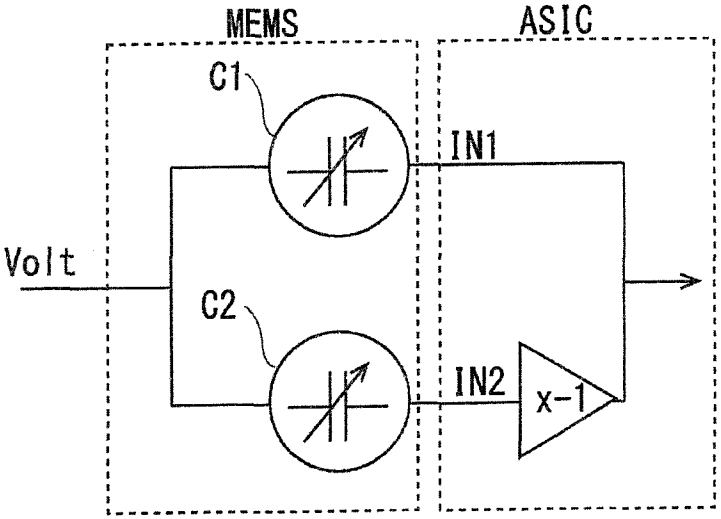
FIGS. 9A and 9B are a sectional view and an equivalent circuit diagram of the vicinity of a back plate and a vibration electrode film of an acoustic sensor according to one or more embodiments of the present invention.
Figure 9A:
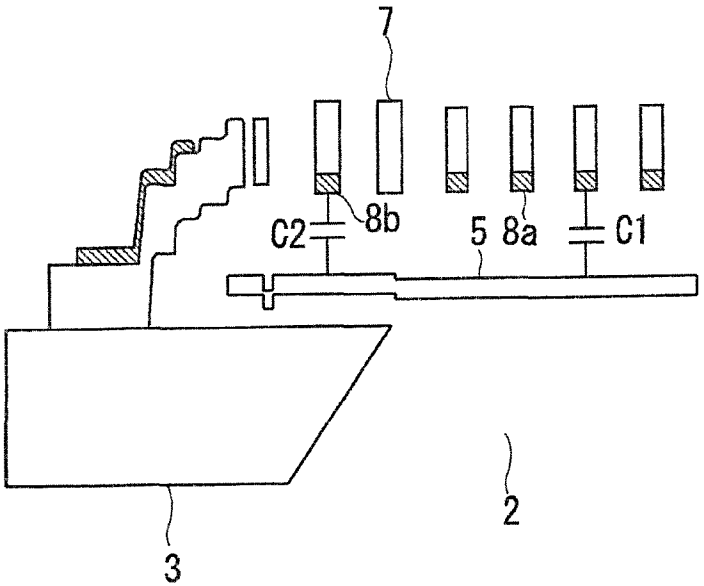

FIG. 9A is a sectional view of the vicinity of the back plate 7 and the vibration electrode film 5 of the acoustic sensor 1 in one or more embodiments, and FIG. 9B is an equivalent circuit diagram obtained in that configuration. As illustrated in FIG. 9A, in one or more embodiments, the fixed electrode film 8 of the back plate 7 is divided into a first fixed electrode film 8*a* and a second fixed electrode film 8*b*. The vibration electrode film 5 and the first fixed electrode film 8*a* constitute the first capacitor C1. The vibration electrode film 5 and the second fixed electrode film 8*b* constitute the second capacitor C2. That is, in one or more embodiments, both the first capacitor C1 and the second capacitor C2 are made up of the vibration electrode film 5 and the fixed electrode film 8 of the back plate 7.

Further, in one or more embodiments, the signal from the first capacitor C1 and the signal from the second capacitor C2 have the same polarity, and the noise of the signal from the first capacitor C1 and the noise of the signal from the second capacitor C2 also have the same polarity. Accordingly, canceling the noises concerning the signals from the first capacitor C1 and the second capacitor C2 requires subtraction of the signal from the first capacitor C1 and the signal from the second capacitor C2, rather than addition of those signals.

Hence in one or more embodiments, as illustrated in FIG. 9B, the output IN1 of the first capacitor C1 and the output IN2 of the second capacitor C2 are each inputted into the ASIC. Then, after IN2 is reversed in the ASIC, both outputs are added to each other. It is thereby possible to more reliably improve the SN ratio as the acoustic sensor system by matching the levels of the noises concerning the signal from the first capacitor C1 and the signal from the second capacitor C2 and canceling the noise of the signal from the first capacitor C1 and the noise of the signal from the second capacitor C2, while providing a certain difference between the levels of the respective signals.

Figure 10B:
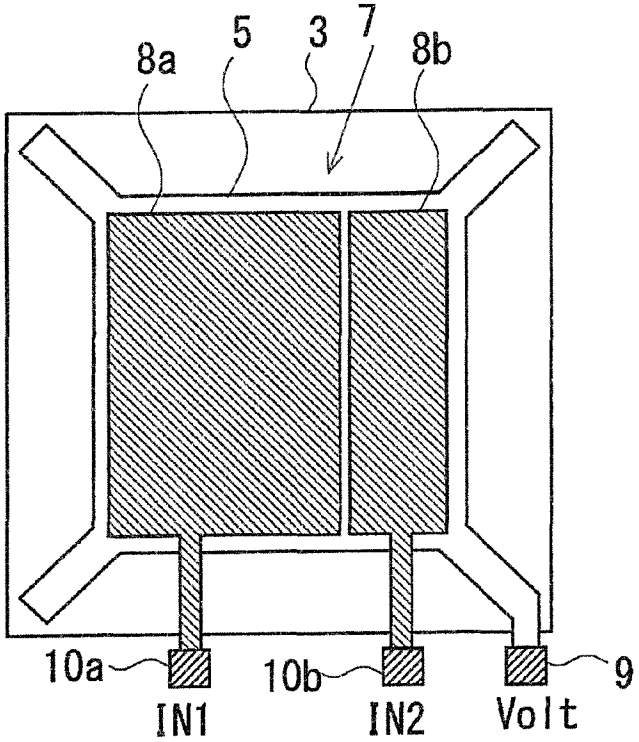
FIGS. 10A and 10B are views illustrating configuration examples of a first fixed electrode and a second fixed electrode according to one or more embodiments of the present invention.
Figure 10A:
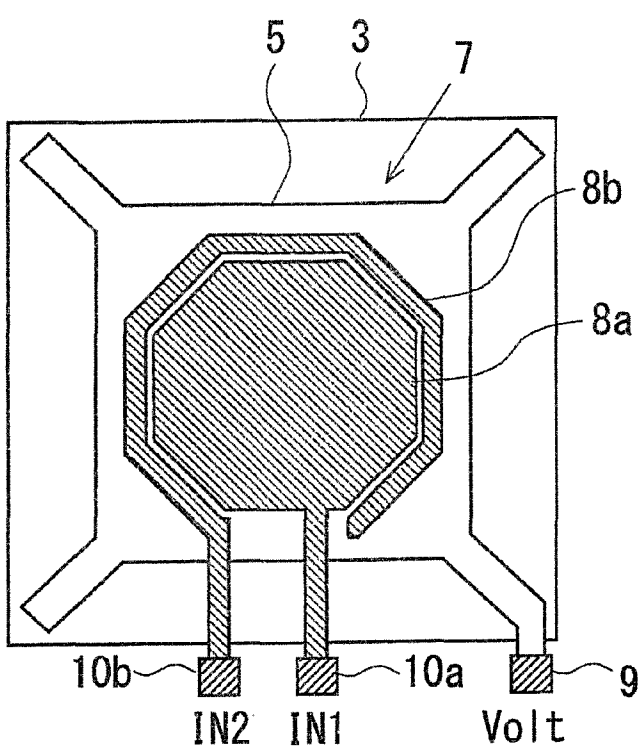

FIGS. 10A and 10B illustrate examples of a dividing method in the case of dividing the fixed electrode of the back plate 7 into the first fixed electrode film 8*a* and the second fixed electrode film 8*b*. The second fixed electrode film 8*b* may be disposed so as to enclose the first fixed electrode film 8*a* as illustrated in FIG. 10A, or the first fixed electrode film 8*a* and the second fixed electrode film 8*b* may be disposed side by side as illustrated in FIG. 10B.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A capacitive transducer system comprising:

a capacitive transducer; and a controller, wherein the capacitive transducer comprises:

a first fixed electrode, a second fixed electrode, and a vibration electrode disposed between the first fixed electrode and the second fixed electrode so as to face the first and second fixed electrodes through gaps, wherein a first capacitor is formed by the first fixed electrode and the vibration electrode, wherein a second capacitor is formed by the second fixed electrode and the vibration electrode, wherein the capacitive transducer is configured to convert transformation of the vibration electrode into changes in capacitance in the first capacitor and the second capacitor, wherein the controller is configured to process voltages supplied to the first capacitor and the second capacitor and/or signals based on the changes in capacitance of the first capacitor and the second capacitor, wherein the signals based on the changes in capacitance of the first capacitor and the second capacitor are added or subtracted in such a direction as to cancel each other, wherein the first fixed electrode is a semiconductor substrate having an opening, wherein the second fixed electrode is a fixed electrode film disposed so as to face the opening of the semiconductor substrate, and formed in a back plate having sound holes that allow passage of air, wherein the vibration electrode is a vibration electrode film disposed between the back plate and the semiconductor substrate so as to face the back plate and the semiconductor substrate respectively through gaps, wherein the semiconductor substrate has a surface to be conductive, or is formed of a conductive material, wherein the vibration electrode film is provided with a stopper that comes into contact with the semiconductor substrate when the vibration electrode film is transformed to the semiconductor substrate side, and wherein an insulation made of an insulator is provided at a tip of the stopper on the semiconductor substrate side.

2. The capacitive transducer system according to claim 1, wherein a value of at least one of an electrode area, an electrode position, an inter-electrode gap, a supplied voltage, and a gain of each of the first fixed electrode, the second fixed electrode, and the vibration electrode is decided such that a level of the signal based on the change in capacitance of the first capacitor and a level of the signal based on the change in capacitance of the second capacitor are different from each other, and a noise level of the first capacitor and a noise level of the second capacitor are equivalent to each other.

3. The capacitive transducer system according to claim 1, wherein the fixed electrode film is formed on a surface of a portion in the semiconductor substrate, the portion facing the vibration electrode film.

4. The capacitive transducer system according to claim 1, wherein by electrical connection between a signal line of the signal based on the change in capacitance of the first capacitor and a signal line of the signal based on the change in capacitance of the second capacitor, the respective signals based on the changes in capacitance of the first capacitor and the second capacitor are added or subtracted in such a direction as to cancel each other.

5. The capacitive transducer system according to claim 1, wherein the signal based on the change in capacitance of the first capacitor and the signal based on the change in capacitance of the second capacitor are calculated by addition or subtraction in such a direction as to cancel each other in the controller.

6. The capacitive transducer system according to claim 1, wherein the first fixed electrode and the second fixed electrode are formed by dividing the fixed electrode film formed on the back plate, wherein the signal based on the change in capacitance of the first capacitor and the signal based on the change in capacitance of the second capacitor are calculated by addition or subtraction in such a direction as to cancel each other in the controller.

7. An acoustic sensor, comprising the capacitive transducer system according to claim 1, and configured to detect sound pressure.

8. A capacitive transducer comprising:

a semiconductor substrate having an opening;

a back plate disposed so as to face the opening of the semiconductor substrate, and having sound holes that allow passage of air; and a vibration electrode film disposed between the back plate and the semiconductor substrate so as to face the back plate and the semiconductor substrate respectively through gaps, wherein the capacitive transducer is configured to convert transformation of the vibration electrode film into changes in capacitance between the vibration electrode film and the back plate and between the vibration electrode and the semiconductor substrate, wherein a first capacitor is formed by a first fixed electrode provided in the semiconductor substrate and the vibration electrode film, and transformation of the vibration electrode film is converted into a change in capacitance of the first capacitor, wherein a second capacitor is formed by a second fixed electrode provided in the back plate and the vibration electrode film, and transformation of the vibration electrode film is converted into a change in capacitance of the second capacitor, wherein by electrical connection between a signal line of the signal based on the change in capacitance of the first capacitor and a signal line of the signal based on the change in capacitance of the second capacitor, the respective signals based on the changes in capacitance of the first capacitor and the second capacitor are added to each other and outputted, wherein the vibration electrode film is provided with a stopper that comes into contact with the semiconductor substrate when the vibration electrode film is transformed to the semiconductor substrate side, and wherein an insulation made of an insulator is provided at a tip of the stopper on the semiconductor substrate side.

9. The capacitive transducer according to claim 8, wherein a value of at least one of an electrode area, an electrode position, and an inter-electrode gap of each of the first fixed electrode, the second fixed electrode, and the vibration electrode is decided such that a level of the signal based on the change in capacitance of the first capacitor and a level of the signal based on the change in capacitance of the second capacitor are different from each other, and a noise level of the first capacitor and a noise level of the second capacitor are equivalent to each other.

10. The capacitive transducer according to claim 8, wherein the semiconductor substrate has a surface to be conductive, or is formed of a conductive material.

11. The capacitive transducer according to claim 8, wherein the fixed electrode film is formed on a surface of a portion in the semiconductor substrate, the portion facing the vibration electrode film.

12. An acoustic sensor, comprising the capacitive transducer according to claim 8, and configured to detect sound pressure.

* * * * *